US008303347B2

(12) United States Patent
Chen

(10) Patent No.: US 8,303,347 B2
(45) Date of Patent: Nov. 6, 2012

(54) ELECTRICAL CONNECTOR FOR IMPROVING INTENSITY OF CONTACTS

(75) Inventor: De-Jin Chen, Shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/048,910

(22) Filed: Mar. 16, 2011

(65) Prior Publication Data

US 2011/0318968 A1 Dec. 29, 2011

(30) Foreign Application Priority Data

Jun. 28, 2010 (CN) ..... 2010 20238426

(51) Int. Cl.
*H01R 24/00* (2006.01)

(52) U.S. Cl. ..... 439/660

(58) Field of Classification Search ..... 439/660, 439/884, 862, 627, 630, 500
See application file for complete search history.

(56) References Cited

U.S. PATENT DOCUMENTS 6,454,607 B2 * 9/2002 Bricaud ..... 439/630
7,387,541 B1 * 6/2008 Lai et al. ..... 439/660
7,661,968 B1 * 2/2010 Duan et al. ..... 439/135
7,775,805 B2 * 8/2010 Liao et al. ..... 439/66
7,833,069 B2 * 11/2010 Wu et al. ..... 439/862
8,033,870 B2 * 10/2011 Xie ..... 439/660
8,047,857 B1 * 11/2011 Lu et al. ..... 439/83
2005/0250353 A1 * 11/2005 Soh ..... 439/66
2007/0042615 A1 * 2/2007 Liao ..... 439/66

* cited by examiner

*Primary Examiner* — Alexander Gilman

(74) *Attorney, Agent, or Firm* — Wei Te Chung; Ming Chieh Chang

(57) ABSTRACT

An electrical connector includes an insulative housing defining a plurality of passageways extending in a mating direction and a plurality of contacts secured in the passageways of the insulative housing. The insulative housing further defines a plurality of communicating slots extending downwardly and communicating with the passageways. Each passageway is wider than the communicating slot which is thereabove. Each contact defines a connecting portion receiving in the passageway and a contacting portion bending upwardly from the connecting portion and extending beyond the communicating slot. The connecting portion defines a pair of restricting portions respectively extending from two sides thereof in a direction perpendicular to the mating direction, the pair of restricting portions is prevented in the passageway from extending beyond the communicating slot.

14 Claims, 5 Drawing Sheets

ELECTRICAL CONNECTOR FOR IMPROVING INTENSITY OF CONTACTS

BACKGROUND OF THE INVENTION

1. Field of the Invention

The present invention generally relates to an electrical connector, and more particularly, to a novel structure of an electrical connector preventing the contacts from deforming or damaging.

2. Description of Related Art

An electrical connector includes an insulative housing and a plurality of contacts secured in passageways of the insulative housing. Each contact defines a retention portion retained in the passageway and an elastic contacting portion protruding out of the passageway. The contacting portion of the contact may excess to extend beyond the passageway during the long process of application. Thus, the contact will be deformed or damaged by a complementary contact in a process of the electrical connector mating with a complementary connector. The contact also may sways in the passageway along a lateral direction, it is harmful to electrical connecting of the electrical connector. Thus, an electrical connector with novel contacts for improving intensity of the contacts and protecting electrical connecting of the electrical connector is desired to overcome the disadvantages of the related art.

Hence, the present invention is directed to solving this problem in the related art.

SUMMARY OF THE INVENTION

An object of the invention is to provide an electrical connector preventing the contacts from deforming or damaging.

In order to achieve the object set forth, an electrical connector includes an insulative housing defining a plurality of passageways extending in a mating direction and a plurality of contacts secured in the passageways of the insulative housing. The insulative housing further defines a plurality of communicating slots extending downwardly and communicating with the passageways. Each passageway is wider than the communicating slot which is thereabove. Each contact defines a connecting portion receiving in the passageway and a contacting portion bending upwardly from the connecting portion and extending beyond the communicating slot. The connecting portion defines a pair of restricting portions respectively extending from two sides thereof in a direction perpendicular to the mating direction, the pair of restricting portions is prevented in the passageway from extending beyond the communicating slot.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
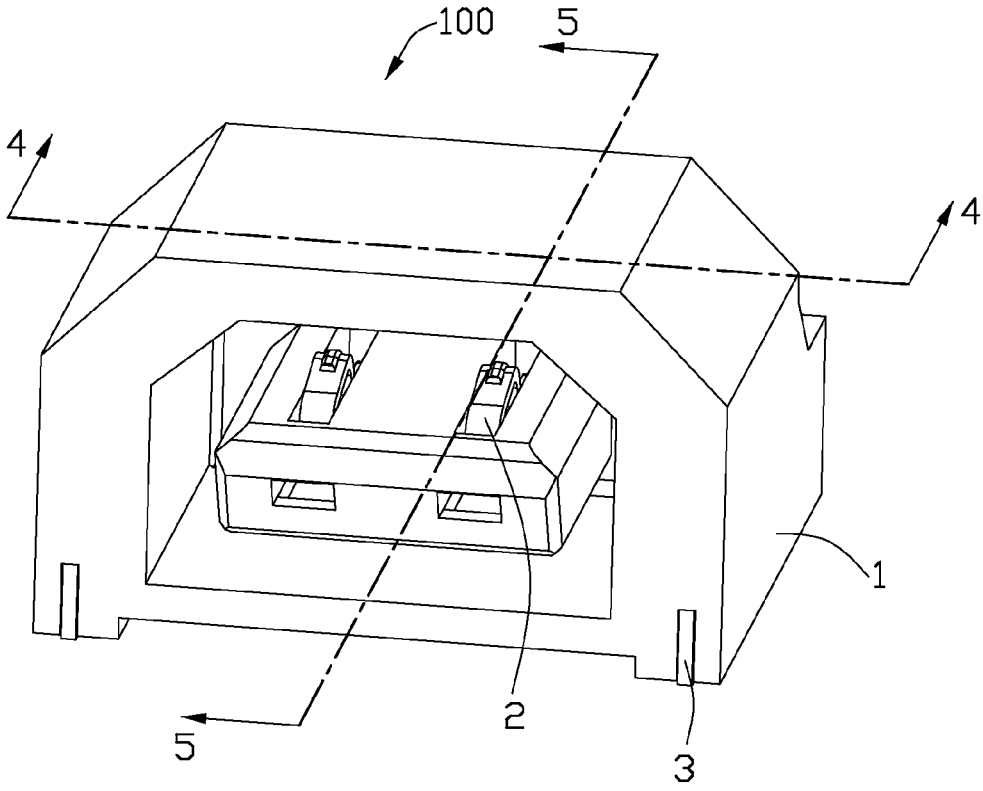
FIG. 1 is a perspective view of an electrical connector of an embodiment of the present invention.
Figure 2:
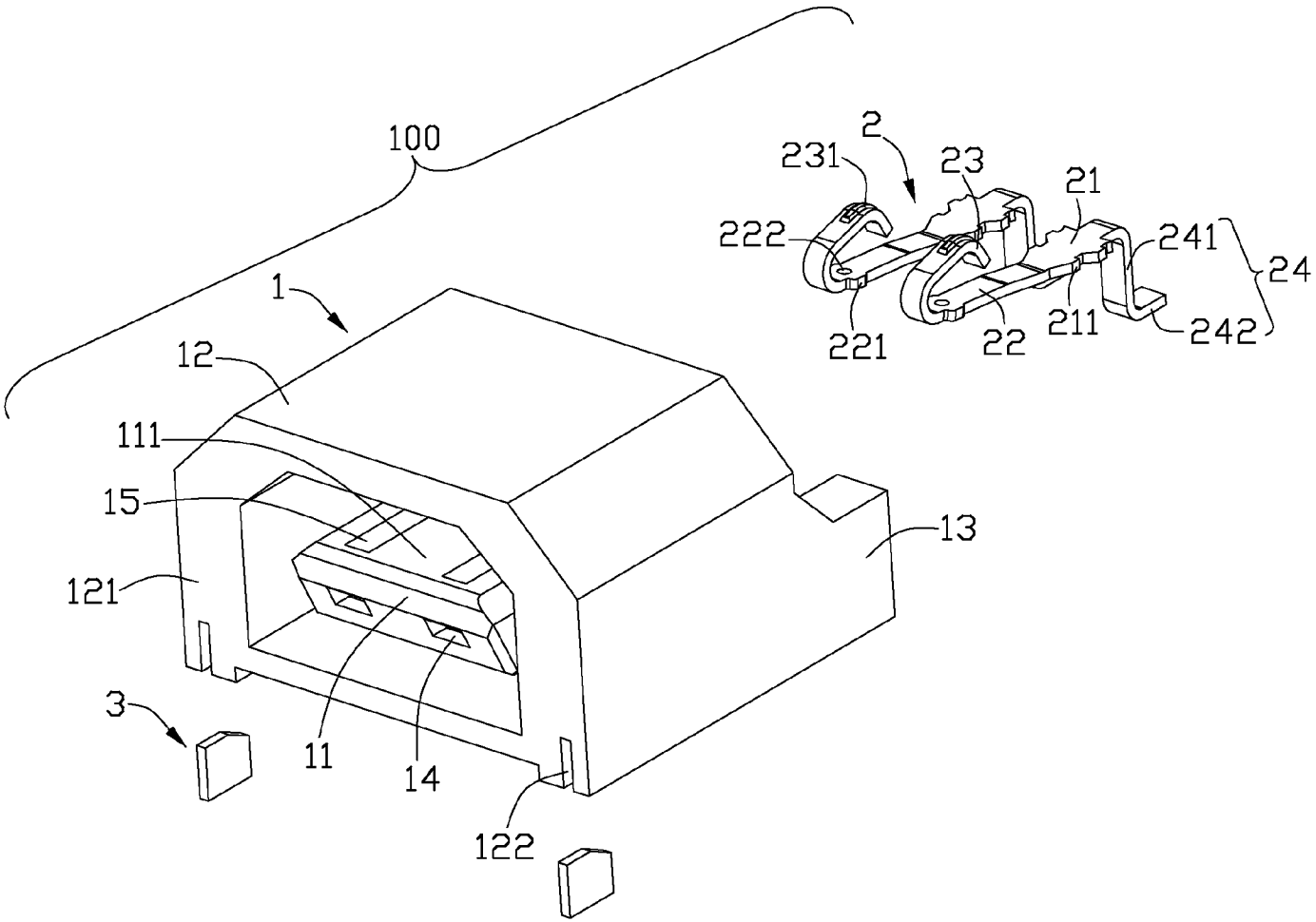
FIG. 2 is an exploded perspective view of the electrical connector as shown in FIG. 1.
Figure 3:
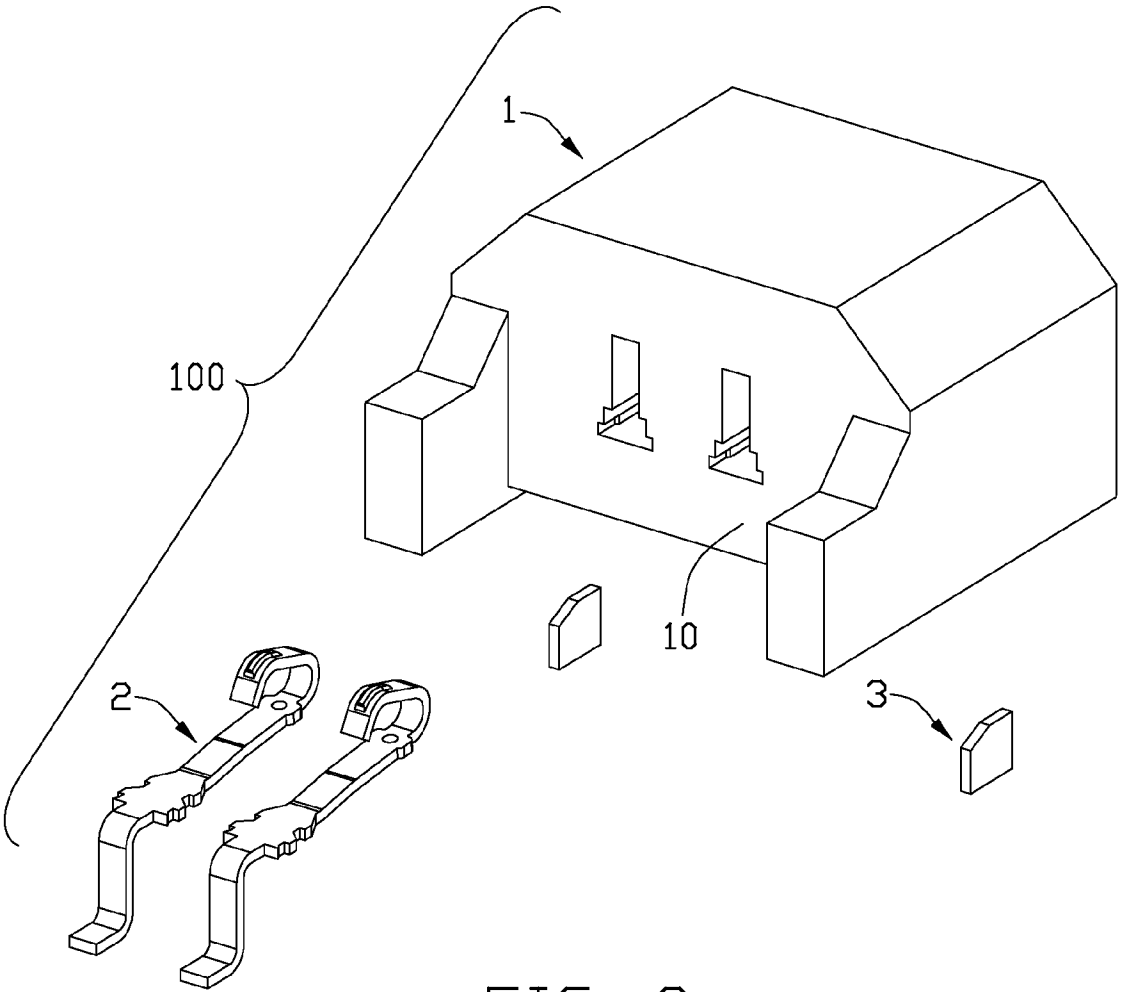
FIG. 3 is a view similar to FIG. 2, while taken from a different aspect.

Referring to FIGS. 1 and 2, an electrical connector 100 in accordance with an embodiment of the present invention comprises an insulative housing 1 defining a plurality of passageways 14 extending in a mating direction and a plurality of contacts 2 secured in the passageways 14 of the insulative housing 1 and arranged in a lateral direction perpendicular to the mating direction.

Figure 4:
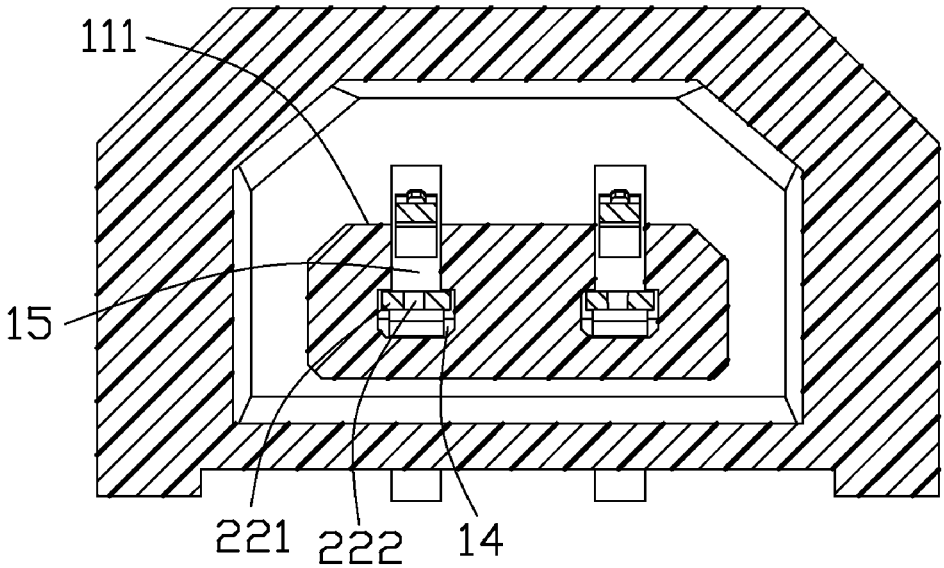
FIG. 4 is a cross section view of the electrical connector of FIG. 1 taken along line 4-4.
Figure 5:
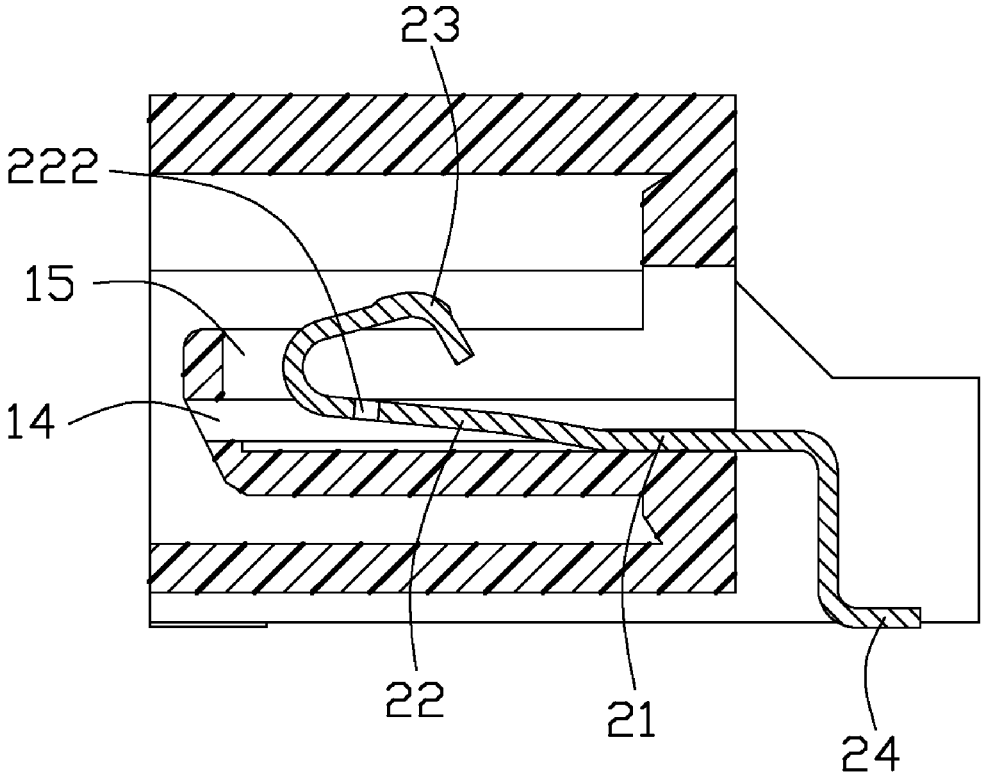
FIG. 5 is a cross section view of the electrical connector of FIG. 1 taken along line 5-5.

Referring to FIGS. 2 and 5, the insulative housing 1 defines a base 10, a tongue portion 11 extending from the base 10 in the mating direction and a mating port 12 receiving the tongue portion 11 and extending from the base 11 in the mating direction. The plurality of passageways 14 extend through the base 10 and the tongue portion 11 in the mating direction. The tongue portion 11 defines a top surface 111 and a plurality of communicating slots 15 recessing downwardly from the top surface 111 thereof and communicating with the passageways 14. In the lateral direction, each passageway 14 is wider than each communicating slot 15 which is above the corresponding passageway 14 (refer to FIG. 4). The mating port 12 defines a mating surface 121, a mounting surface (not shown) perpendicular to the mating surface 121 and a pair of positioning slits 122 extending through the mating surface 121 and the mounting surface and located at two sides of the mating surface 121. The electrical connector 100 further includes a pair of soldering pads 3 retained in the positioning slits 122 for mounting the electrical connector 100 on a print circuit board (not shown). The mating port 12 applies to USB (Universal Serial Bus) interface. The insulative housing 1 further a pair of protecting walls 13 extending in a direction which is opposite to the tongue portion 11 extending and located at two sides of the base 10 for protecting the contacts mounted on the printed circuit board.

Referring to FIGS. 2 and 5, each contact 2 is assembled in the passageway of the insulative housing 10 from back to front. Refer to FIG. 5, each contact 2 has a horizontal retention portion 21 interfered with the passageway 14, a connecting portion 22 leaning upwardly from the retention portion 21 and receiving in the passageway 14, a contacting portion 23 bending upwardly from the connecting portion 22 and extending beyond the communicating slot 15 from the passageway 14 and a soldering portion 24 extending from the retention portion 21 and extending through the base 10. The connecting portion 22 defines a pair of restricting portions 221 respectively extending from two sides thereof in the lateral direction and opposite to the retention portion 21. Because a distance between the pair of restricting portions 221 is wider than the contacting portion 23 in the lateral direction, and the pair of restricting portion 221 is higher than the retention portion 21, the pair of restricting portions 221 prevents the connecting portion 22 in the passageway 14 from extending beyond the communicating slot 15. The pair of restricting portion 221 is located under the contacting portion 23 for limiting the contacting portion 23 excessively protruding out of the communicating slot 15. The connecting portion 22 defines a through-hole 222 between the pair of restricting portions 221 for improving intensity of the contact 2. The contacting portion 23 is curve-shape and defines a tuber 231 protruding therefrom for improving contacting impact. The retention portion 21 defines a plurality of interferential portion 211 at two sides thereof for making the contact retained in the passageway 14. The soldering portion 24 has an upright section 241 perpendicular to the retention portion 21 and a horizontal section 242 parallel to the retention portion 21. The upright section 241 connects with the retention portion 21 and the horizontal portion 242. The soldering portion 24 is between the pair of the protecting walls 13.

In the invention, the contact 2 defines a pair of restricting portions 221 at two sides of the connecting portion 22 for preventing the contacts from deformation or damaging. And the contact 2 defines a through-hole 222 on the connecting portion 22 for improving intensity of the contact 2. It can overcome the disadvantages of the contact in industry.

The present invention will now be described in detail with reference to a preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

What is claimed is:

1. An electrical connector comprising:

an insulative housing defining a mating port and a tongue portion received in the mating port extending in mating direction and a width direction perpendicular to the mating direction, the tongue portion defining a plurality of passageways extending in the mating direction and a plurality of communicating slots extending downwardly and communicating with the passageways, each passageway wider than the communicating slot which is thereabove;

a plurality of contacts secured in the passageways of the insulative housing, each contact defining a pair of retention portion retained in the passageway, a connecting portion receiving in the passageway and a contacting portion bending upwardly from the connecting portion through the communicating slot to the mating port, the connecting portions elastically moving in the passageways in a thickness direction perpendicular to the tongue portion;

wherein the connecting portion defines a pair of restricting portions respectively extending from two sides thereof in the width direction, the pair of restricting portions is substantially equal to the passageway in a width dimension so that the restricting portions prevents the connecting portion in the passageway from extending beyond the communicating slot and from swaying in the passageway.

2. The electrical connector as claimed in claim 1, wherein the pair of restricting portions is located under the contacting portion, a through-hole is defined on the connecting portion and between the pair of restricting portions.

3. The electrical connector as claimed in claim 2, wherein the housing defines a base, said tongue portion extending from the base in the mating direction and said mating port receiving the tongue portion and extending from the base in the mating direction, the passageways extend through the base and the tongue portion, the communicating slots recess downwardly from a top face of the tongue portion.

4. The electrical connector as claimed in claim 3, wherein the housing further defines a pair of protecting walls extending in a direction which is opposite to the tongue portion extending and defined at two sides of the base.

5. The electrical connector as claimed in claim 4, wherein each contact further defines a soldering portion extending from the retention portion and extending through the base, the soldering portions of the contacts are between the pair of protecting walls.

6. An electrical contact comprising:

a retention portion defined in a horizontal direction;

a connecting portion extending forward from the retention portion, a pair of restricting portions defined at two sides of the connecting portion and opposite to the retention portion;

a contacting portion bending upwardly from the connecting portion and shrouding on the pair of restricting portions, a distance between the pair of restricting portions is wider than the contacting portion in a lateral direction;

wherein the connecting portion leans upwardly from the retention portion, the pair of restricting portions is higher than the retention portion;

wherein a through hole is defined on the connecting portion and between the pair of restricting portions.

7. The electrical contact as claimed in claim 6, wherein each contact further defines a soldering portion extending from the retention portion, the soldering portion having an upright section perpendicular to the retention portion and a horizontal section parallel to the retention portion.

8. An electrical connector comprising:

an insulative housing defining a front face, a mating port formed in the housing and extending through the front face in a front-to-back direction to communicate with an exterior;

a plurality of passageways extending along said front-to-back direction in the housing;

a plurality of communicating slots extending along the front-to-back direction and respectively communicating with the corresponding passageways in a vertical direction perpendicular to said front-to-back direction;

a plurality of contacts disposed in the housing, each of said contacts including a retention portion and a connecting portion extending from the retention portion and toward the corresponding communicating slot under condition that both said retention portion and said connecting portion essentially located within the corresponding passageway wherein the connecting portion extends obliquely with at least one stopper formed on an adjacent end thereof to abut against a step structure of the housing on an interface of the passageway and the corresponding communicating slot for preventing excessive movement of the connecting portion toward the communicating slot, and a contacting section extending from the adjacent end of the connecting portion through the communicating slot and exposed upon a mating face in the mating port; wherein a dimension of the passageway in the vertical direction is larger than a thickness of the corresponding contact so as to allow the connecting portion to be up and down moveable along the vertical direction in the corresponding passageway when the contacting section is coupled to a complementary electrical part and moveable in the vertical direction;

wherein said mating face is formed on a mating tongue horizontally extending in the mating port.

9. The electrical connector as claimed in claim 8, wherein the passageway is further equipped with a pair of retention grooves by two sides to receive a pair of corresponding barb structures formed on two sides of the retention portion.

10. The electrical connector as claimed in claim 8, wherein each of the passageways extends through a front face of the mating tongue.

11. The electrical connector as claimed in claim 10, wherein the communicating slots do not extend through the front face of the mating tongue.

12. The electrical connector as claimed in claim 8, wherein each of said contacts defines an opening therethrough in a thickness direction around said stopper.

13. The electrical connector as claimed in claim 8, wherein both said passageways and the corresponding communicating slots extend through a rear face of the housing so as to allow the corresponding contacts to be assembled thereinto through said rear face.

14. The electrical connector as claimed in claim 8, wherein the stopper defines a pair of outward protrusions on two opposite sides of the connecting portion.

* * * * *